US006937162B2

(12) United States Patent
Tokitsu et al.

(10) Patent No.: US 6,937,162 B2
(45) Date of Patent: Aug. 30, 2005

(54) IN-VEHICLE APPARATUS AND SERVICE PROVIDING SYSTEM

(75) Inventors: Naoki Tokitsu, Kariya (JP); Ichiro Yoshida, Takahama (JP)

(73) Assignee: Denso Corporation, Kariya (JP)

( * ) Notice: Subject to any disclaimer, the term of this patent is extended or adjusted under 35 U.S.C. 154(b) by 691 days.

(21) Appl. No.: 09/950,682

(22) Filed: Sep. 13, 2001

(65) Prior Publication Data

US 2002/0032506 A1 Mar. 14, 2002

(30) Foreign Application Priority Data

Sep. 14, 2000 (JP) ..... 2000-279905

(51) Int. Cl.[7] ..... G08G 1/00

(52) U.S. Cl. ..... 340/928; 340/425.5; 340/438; 340/539.1; 701/29

(58) Field of Search ..... 340/928, 933, 340/932.2, 425.5, 438, 459, 539.1, 539.13; 701/29

(56) References Cited

U.S. PATENT DOCUMENTS

| | | | | |
|---|---|---|---|---|
| 5,508,917 | A | 4/1996 | Siegle et al. | |
| 5,554,984 | A | 9/1996 | Shigenaga et al. | |
| 5,710,702 | A * | 1/1998 | Hayashi et al. | 701/1 |
| 5,859,415 | A * | 1/1999 | Blomqvist et al. | 235/384 |
| 5,955,970 | A | 9/1999 | Ando et al. | |
| 5,991,689 | A * | 11/1999 | Aito et al. | 701/209 |
| 6,166,649 | A * | 12/2000 | Inoue | 340/660 |
| 6,195,019 | B1 * | 2/2001 | Nagura | 340/928 |
| 6,337,622 | B1 * | 1/2002 | Sugano | 340/438 |
| 6,584,403 | B2 * | 6/2003 | Bunn | 701/213 |
| 6,647,322 | B1 | 11/2003 | Hayashi et al. | |
| 6,720,920 | B2 * | 4/2004 | Breed et al. | 342/386 |
| 2003/0189498 | A1 | 10/2003 | Kakihara et al. | |

FOREIGN PATENT DOCUMENTS

| | | |
|---|---|---|
| EP | 1 050 853 A1 | 1/1999 |
| JP | A-5-217043 | 8/1993 |
| JP | A-H09-136580 | 5/1997 |
| JP | A-11-213192 | 8/1999 |
| JP | A-H11-238152 | 8/1999 |
| JP | A-H11-509347 | 8/1999 |
| JP | A-2000-137598 | 5/2000 |
| JP | A-2000-163609 | 6/2000 |
| JP | A-2000-207219 | 7/2000 |
| JP | A-2000-215334 | 8/2000 |
| JP | A-2001-076498 | 3/2001 |
| WO | WO 97/04421 | 2/1997 |

OTHER PUBLICATIONS

US 6,516,250, 2/2003, Hayashi et al. (withdrawn)

* cited by examiner

*Primary Examiner*—Daryl C. Pope
(74) *Attorney, Agent, or Firm*—Posz & Bethards, PLC

(57) ABSTRACT

If acquisition of measured position and time data (position/time) from a position detection unit fails, a "GPS OFF mode" is set, and the latest position and time data is stored as start data. Thereafter, when the position and time data is obtained successfully, and the operation is recovered from the "GPS OFF mode", the "GPS OFF mode" is cancelled. Also, the obtained position and time data (restoration data) is stored. Monitor data is formed from the start data and the restoration data. The monitor data is transmitted to a management center through road-vehicle communication. Also, history data of the position and time stored in the position detection unit during the "GPS OFF mode" is read. If the history data satisfies the toll charging condition, the toll charging data is formed and is transmitted to the management center.

15 Claims, 12 Drawing Sheets

REGISTRATION PROCESS

ORDINARY PROCESS

IN-VEHICLE APPARATUS AND SERVICE PROVIDING SYSTEM

CROSS REFERENCE TO RELATED APPLICATION

This application is based on and incorporates herein by reference Japanese Patent Application No. 2000-279905 filed on Sep. 14, 2000.

BACKGROUND OF THE INVENTION

1. Field of the Invention

The present invention relates to an in-vehicle apparatus for executing a toll charging process when a current state of a vehicle (a current position, residence time or the like of the vehicle) satisfies a predetermined toll charging condition. The present invention also relates to a service providing system for providing a particular service through the in-vehicle apparatus.

2. Description of Related Art

To eliminate or reduce a traffic jam at a tollgate of a toll road, an ETC (Electronic Toll Collection) system and an ERP (Electronic Road Pricing) system have been proposed. The ETC system collects a toll without requiring the vehicle to stop at the tollgate. The ERP system collects the toll from a vehicle that enters a particular area (e.g., a downtown area) to reduce traffic density in that area.

In the ETC system, a DSRC (Dedicated Short-Range Communication) radio system is used for road-vehicle communication between a roadside unit installed in the tollgate and an in-vehicle apparatus installed in each corresponding vehicle. The DSRC radio system is a two-way short range radio communication system utilizing a millimeter wave (5.8 GHz) channel and conforms to the industry standard "ARIB STD-T55" specified by a Japanese aggregate corporation, so called "the Association of Radio Industries and Businesses".

In the ERP system, in order to collect the toll in a manner similar to that of the ETC system, it is required to install the roadside unit (antenna) to each entry route leading to the particular area (hereinafter, referred to as "toll area"). Therefore, when many entry routes leading to the toll area exist as in the case of the downtown area or the like, enormous cost and work are required for installation of the roadside units and maintenance and management of these units. For example, one method has been proposed to overcome this disadvantage in Japanese Unexamined Patent Publication No. 11-213192. In this method, the charging process is executed by determining whether a current position of a vehicle is within the toll area based on a result of position measurement using a GPS (Global Positioning System) receiver installed in the vehicle.

In order to realize such ETC system and ERP system, it is required to install an in-vehicle apparatus adapted to these systems to each vehicle.

However, various illegal operations may be conducted on these in-vehicle apparatuses. For example, in a case of using an IC card for identifying an object (e.g., a vehicle) to be charged, someone may intentionally remove the IC card from an IC card reader connected to the in-vehicle apparatus. Also, in a case of executing the charging process based on a result of position measurement with the GPS receiver, someone may intentionally disconnect a signal line connected to the GPS receiver or may intentionally turn off the power to the GPS receiver. Theses actions disable the determination of whether the toll charging condition is satisfied. Furthermore, someone may install and run an illegal program in the in-vehicle apparatus to get rid of the toll charge. Therefore, an effective countermeasure for such illegal operations has been demanded.

SUMMARY OF THE INVENTION

It is therefore an objective of the present invention to provide an in-vehicle apparatus that can detect illegal operations applied thereto to enable fair and reliable toll charging operation and to prevent illegal operations applied thereto. It is another objective of the present invention to provide a service providing system that uses such an in-vehicle apparatus.

To achieve the objective of the present invention, there is provided an in-vehicle apparatus including a position and time measuring means, a communication means, a toll charge control means, an abnormal condition detecting means and a monitor control means. The position and time measuring means measures a current position of a vehicle and current time. The communication means communicates with an external management apparatus to exchange various information through wireless communication. The toll charge control means determines a running state of the vehicle based on measurements of the position and time measuring means and forms toll charging data if the running state of the vehicle satisfies a predetermined toll charging condition. Furthermore, the toll charge control means transmits the toll charging data to the management apparatus through the communication means. The toll charging data includes at least toll information and object identification information. The toll information indicates a toll determined based on the toll charging condition. The object identification information identifies an object to be charged the toll. The abnormal condition detecting means detects an abnormal condition in the in-vehicle apparatus. The monitor control means forms monitor data when the abnormal condition is detected by the abnormal condition detecting means and transmits the monitor data to the management apparatus through the communication means. The monitor data includes at least apparatus identification information, the current position of the vehicle and the current time. The current position of the vehicle and the current time are measured by the position and time measuring means when the abnormal condition is detected. The apparatus identification information identifies the in-vehicle apparatus.

To achieve the objective of the present invention, there may be alternatively provided an in-vehicle apparatus including a first interface means, a communication means, a toll charge control means, an abnormal condition detecting means and a monitor control means. Measured position and time data is inputted to the first interface means. The measured position and time data indicates a current position of a vehicle and current time. The communication means communicates with an external management apparatus to exchange various information through wireless communication. The toll charge control means determines a running state of the vehicle based on the measured position and time data inputted through the first interface means and forms toll charging data if the running state of the vehicle satisfies a predetermined toll charging condition. The toll charge control means transmits the toll charging data to the management apparatus through the communication means. The toll charging data includes at least toll information and object identification information. The toll information indicates a toll determined based on the toll charging condition. The object identification information identifies an object to be charged the toll. The abnormal condition detecting means detects an abnormal condition in the in-vehicle apparatus. The monitor control means forms monitor data when the abnormal condition is detected by the abnormal condition detecting means and transmits the monitor data to the management apparatus through the communication means. The monitor data includes at least the measured position and time data inputted through the first interface means.

To achieve the objective of the present invention, there may be further alternatively provided an in-vehicle apparatus including a position and time measuring means, a second interface means, a toll charge control means, an abnormal condition detecting means and a monitor control means. The position and time measuring means measures a current position of a vehicle and current time. A communication device is connected to the second interface means. The communication device communicates with an external management apparatus to exchange various information through wireless communication. The toll charge control means determines a running state of the vehicle based on measurements of the position and time measuring means and forms toll charging data if the running state of the vehicle satisfies a predetermined toll charging condition. Furthermore, the toll charge control means outputs the toll charging data through the second interface means. The toll charging data includes at least toll information and object identification information. The toll information indicates a toll determined based on the toll charging condition. The object identification information identifies an object to be charged the toll. The abnormal condition detecting means detects an abnormal condition in the in-vehicle apparatus. The monitor control means forms monitor data when the abnormal condition is detected by the abnormal condition detecting means and outputs the monitor data through the second interface means. The monitor data includes at least the current position of the vehicle and the current time measured by the position and time measuring means when the abnormal condition is detected.

To achieve the objective of the present invention, there may be further alternatively provided an in-vehicle apparatus including a first interface means, a second interface means, a toll charge control means, an abnormal condition detecting means and a monitor control means. Measured position and time data is inputted to the first interface means. The measured position and time data indicates a current position of a vehicle and current time. a communication device is connected the second interface means. The communication device communicates with an external management apparatus to exchange various information through wireless communication. The toll charge control means determines a running state of the vehicle based on the measured position and time data inputted through the first interface means and forms toll charging data if the running state of the vehicle satisfies a predetermined toll charging condition. The toll charge control means outputs the toll charging data through the second interface means. The toll charging data includes at least toll information and object identification information. The toll information indicates a toll determined based on the toll charging condition. The object identification information identifies an object to be charged the toll. The abnormal condition detecting means detects an abnormal condition in the in-vehicle apparatus. The monitor control means forms monitor data when the abnormal condition is detected by the abnormal condition detecting means and outputs the monitor data through the second interface means. The monitor data includes at least the measured position and time data inputted through the first interface means.

To achieve the objective of the present invention, there is provided a service providing system. The service providing system makes an in-vehicle apparatus to acquire an application program through wireless communication with an external management apparatus and also makes the in-vehicle apparatus to execute the application program to provide a particular service through the in-vehicle apparatus. The service providing system disables execution of the application program by the in-vehicle apparatus when an abnormal condition of the in-vehicle apparatus is detected. The service providing system then makes the in-vehicle apparatus to reacquire the application program.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Various embodiments of the present invention will be described with reference to the accompanying drawings.

(First Embodiment)

Figure 1:
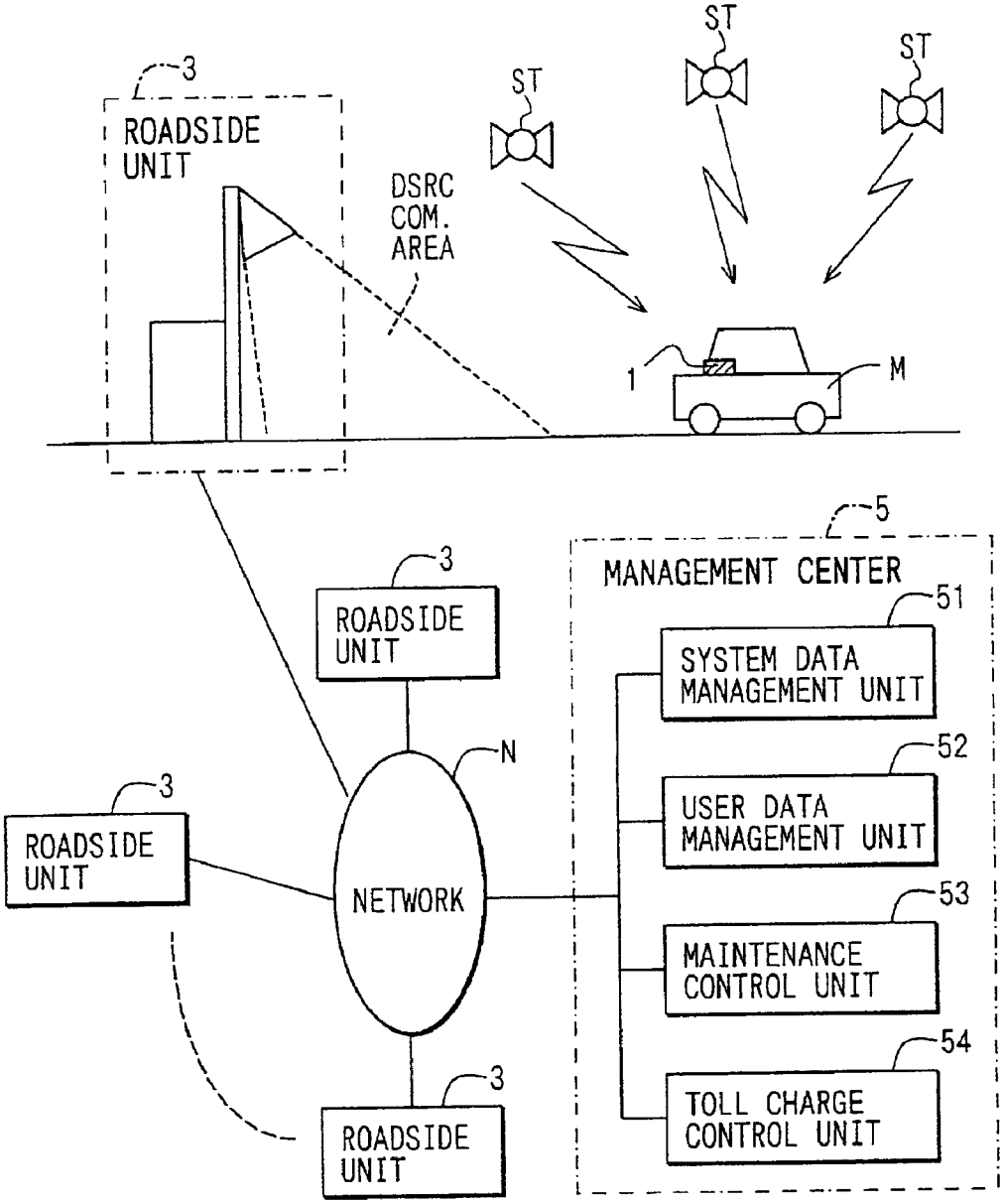
FIG. 1 is a schematic diagram showing an automatic toll charging system.

As is illustrated in FIG. 1, an automatic toll charging system (or a service providing system) according to a first embodiment of the present invention includes an in-vehicle apparatus 1, a plurality of roadside unites 3 and a management center 5. The in-vehicle apparatus 1 is installed in a vehicle M and determines a current position of the vehicle M upon receiving a radio signal indicative of the current position of the vehicle from a GPS satellite ST. Each roadside unit 3 communicates with the in-vehicle apparatus 1. The management center 5 acts as a management apparatus of the present invention communicated with each roadside unit 3 via a communication network N.

Each roadside unit 3 communicates with the in-vehicle apparatus 1 through a well known DSRC radio system having a short communication range of about 3 to 30 m (hereinafter, this communication is referred to as "road-vehicle communication"). Each roadside unit 3 is installed as a part of an ETC system at a corresponding tollgate of a toll road for collecting a toll from a vehicle entering the tollgate. Also, the roadside units 3 are installed along main roads and other locations (e.g., gas stations, parking lots, etc) where a relatively large number of vehicles are present.

The management center 5 includes a system data management unit 51, a user data management unit 52, a maintenance control unit 53 and a toll charge control unit 54. The system data management unit 51 manages system data that is commonly used for each in-vehicle apparatus 1. The system data includes an application program for conducting an automatic toll charging process (ETC/ERP) to be downloaded to the in-vehicle apparatus 1 through the roadside unit 3. The system data also includes toll area data, toll charge condition data and the like. The user data management unit 52 manages user data of registered in-vehicle apparatuses 1. The maintenance control unit 53 downloads the system data from the in-vehicle apparatus 1 and controls registration of the in-vehicle apparatus 1, from which the system data has been downloaded. Furthermore, the maintenance control unit 53 also controls update (redownload) of the system data of the registered in-vehicle apparatus 1. The toll charge control unit 54 executes a procedure for withdrawing a toll from a bank account of a user of the in-vehicle apparatus 1 based on toll charge data transmitted from the in-vehicle apparatus 1 through the road-vehicle communication. The toll charge control unit 54 also conducts a countermeasure for illegal operations applied to the in-vehicle apparatus 1 based on monitor data transmitted from the in-vehicle apparatus 1 through the road-vehicle communication. The monitor data informs an abnormal condition of the in-vehicle apparatus 1.

The in-vehicle apparatus 1 can communicate with the roadside unit 3 and the management center 5 when the in-vehicle apparatus 1 is within a communication range of the roadside unit 3. The in-vehicle apparatus 1 obtains the application program for conducting the automatic toll charging process by downloading the same from the management center 5 through the road-vehicle communication and can provide the automatic charging service by executing the obtained application program.

In addition, the management center 5 registers the in-vehicle apparatus 1, which has executed the download of the application program. Furthermore, for each in-vehicle apparatus 1, the management center 5 stores a setup log of the downloaded application program and also an update history of each data.

Figure 2:
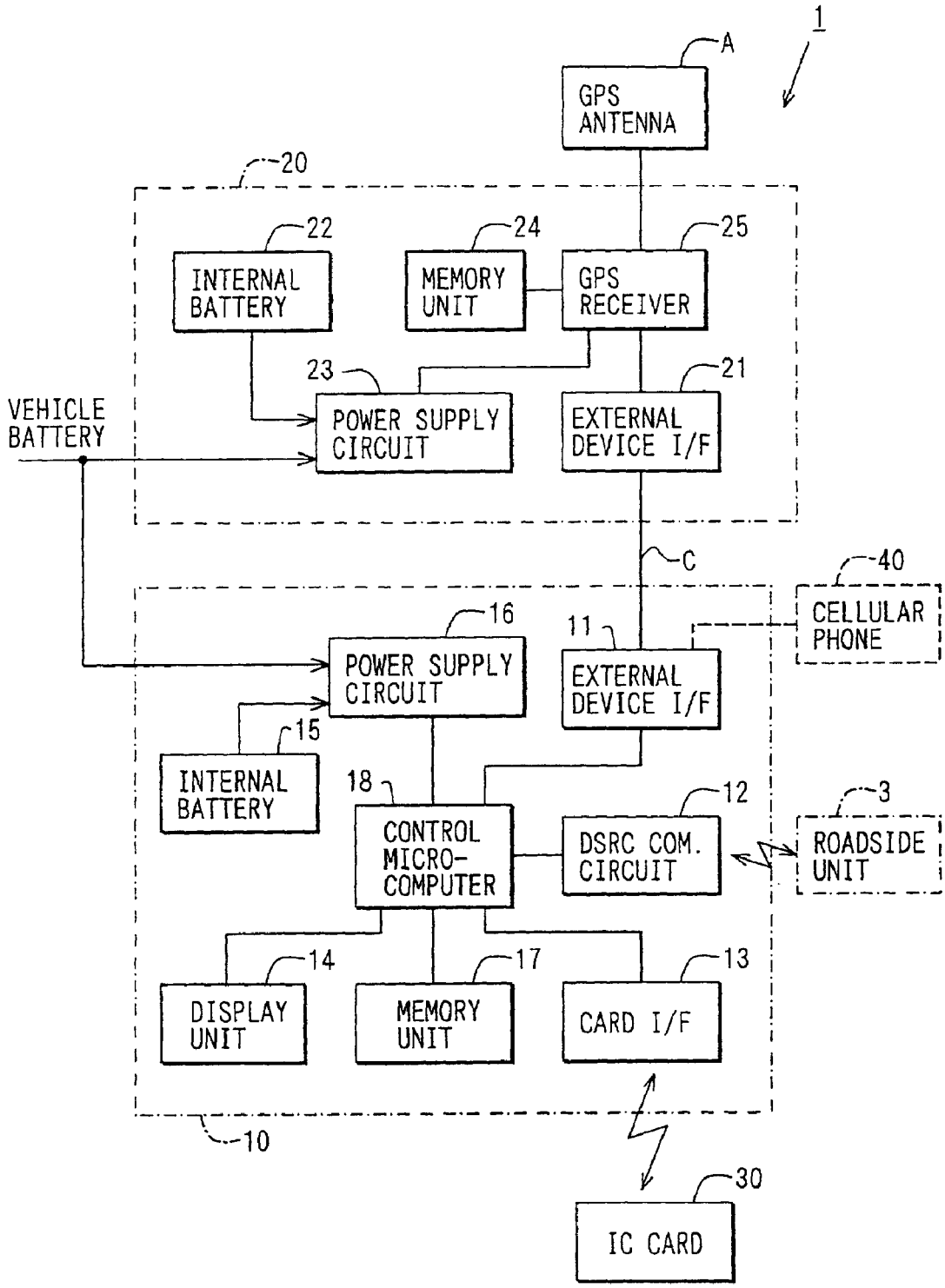
FIG. 2 is a block diagram illustrating a structure of an in-vehicle apparatus according to a first embodiment of the present invention.

As shown in FIG. 2, the in-vehicle apparatus 1 includes a main unit 10 and a position detection unit 20, which are connected with each other through a communication cable C. These units 10, 20 are connected to a vehicle battery (not shown) to receive electrical power therefrom.

The position detection unit 20 includes an external device interface 21, an internal battery 22, a power supply circuit 23, a memory unit 24 and a GPS receiver 25. The external device interface 21 is used to couple the position detection unit 20 to an external device(s) (including at least the main unit 10) through the communication cable C. The internal battery 22 acts as an auxiliary power supply circuit including a rechargeable secondary battery. The power supply circuit 23 is connected to the external power source (vehicle battery) to receive the power therefrom. The power supply circuit 23 supplies the power to each component of the position detection unit 20 and recharges the internal battery 22. When the power supply from the external power source is turned off, the power supply circuit 23 is switched to supply the power from the internal battery 22 to each component of the position detection unit 20. The memory unit 24 includes an electrically erasable read only memory (EEPROM) that allows erasing of stored data from its specified memory location. The GPS receiver 25 has a known microcomputer, which includes a central processing unit (CPU), a read-only memory (ROM) and a random-access memory (RAM). The GPS receiver 25 acts as a position and time measuring means. The GPS receiver 25 generates measured position and time data (hereinafter, simply referred to as measured position data) based on signals transmitted from the GPS satellite ST through a GPS antenna A and controls each component of the position detection unit 20. The measured position data includes a current position of the in-vehicle apparatus 1 and a corresponding measurement time at which the current position is measured.

The ROM of the GPS receiver 25 stores basic programs for performing minimum functions in the unit 20. One example of these basic programs is a program for generating the measured position data from the signals received through the GPS antenna A. Another example of these basic programs is a program for running an input/output process for inputting/outputting commands and data through the external device interface 21.

The main unit 10 includes an external device interface 11, a DSRC communication circuit 12, a card interface 13, a display unit 14, an internal battery 15, a power supply circuit 16, a memory unit 17 and a control microcomputer 18. The external device interface 11 acts as a first interface means for coupling an external device(s) (including at least the position detection unit 20) to the main unit 10. The DSRC communication circuit 12 acts as a communication means for conducting radio communication or wireless communication between the roadside unit 3 and the main unit 10. The card interface 13 acts as an information reading means for reading information from an IC card (recording medium) 30 in which object identification information (a member identification number, a bank account number or the like) for identifying the object to be charged when an application program for conducting a toll charging process, such as the automatic toll charging process or the like, is executed. The display unit 14 displays operation procedures of the in-vehicle apparatus 1, processed result and various other information. The internal battery 15, the power supply circuit 16 and the memory unit 17 are similar to the internal battery 22, the power supply circuit 23 and the memory unit 24 of the position detection unit 20. The control microcomputer 18 includes a CPU, a ROM and a RAM and controls each component of the main unit 10.

The ROM of the control microcomputer 18 stores basic programs for performing minimum functions in the unit 10. One example of these basic programs is a program for conducting a main process that executes various sub processes based on commands received upon communications between the roadside unit 3 and the main unit 10 through the DSRC communication circuit 12. Another example of these basic programs is a program for conducting an input/output process for inputting/outputting commands and data through the external device interface 11.

The main unit 10 constitutes a main unit of the present invention. The position detection unit 20 constitutes a detection unit of the present invention. The internal battery 15 and the power supply circuit 16 constitute an auxiliary power supply means of the present invention which can supply the power for a limited time period. The internal battery 22 and the power supply circuit 23 constitute another auxiliary power supply means of the present invention. The memory unit 17 constitutes a monitor data storing means. The memory unit 24 constitutes a history data storing means of the present invention.

Figure 3:
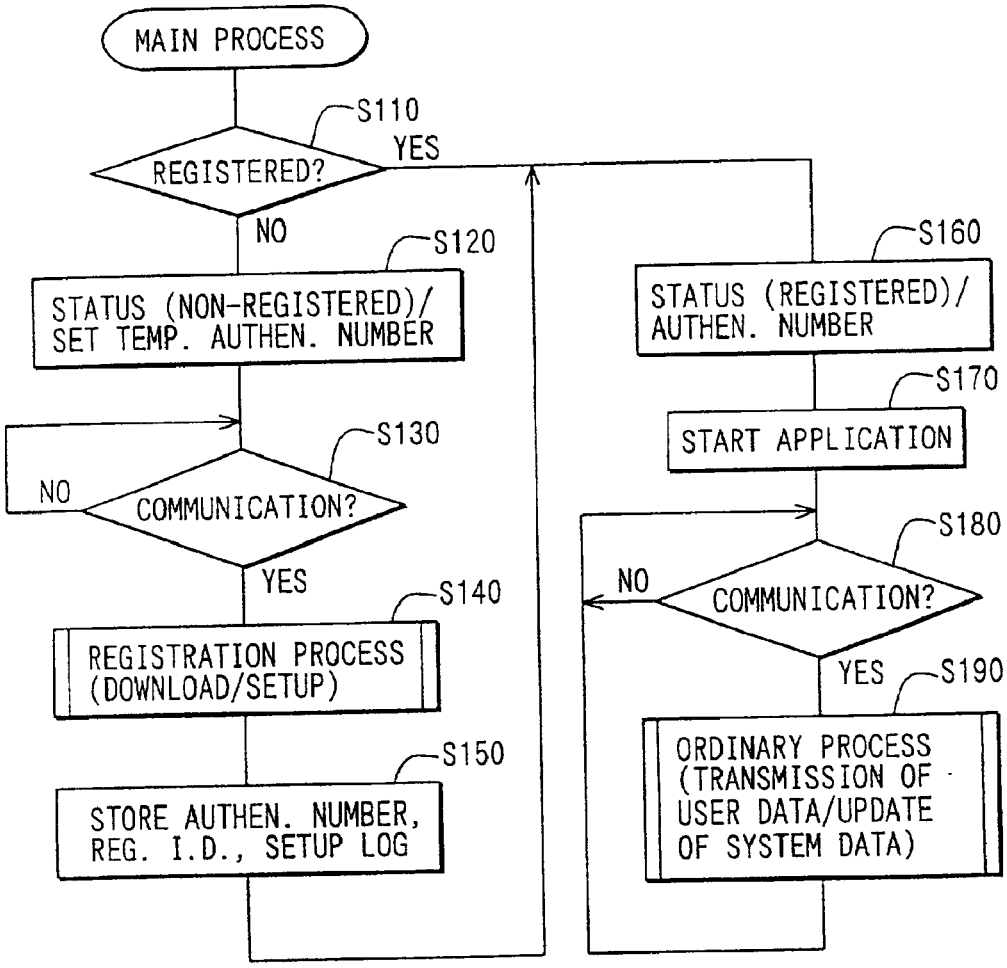
FIG. 3 is a flowchart showing a main process carried out by a main unit of the in-vehicle apparatus.

The main process executed by the control microcomputer 18 of the main unit 10 will be explained with reference to a flowchart of FIG. 3.

After the power supply from the vehicle battery to the main unit 10 is initiated, and an initialization process, such as a hardware check process, is performed, the main process starts. First, at step S110, it is determined whether the in-vehicle apparatus 1 has been registered to the management center 5. Specifically, if the in-vehicle apparatus 1 has been registered, an official authentication number and a registration ID are given to the in-vehicle apparatus 1 from the management center 5. Therefore, such determination can be made depending on whether such number and ID are given to the in-vehicle apparatus 1.

If, the in-vehicle apparatus 1 has not been registered, the process goes to step S120. At step S120, status information indicative of a no-registered state of the in-vehicle apparatus 1 and a temporary authentication number previously assigned to the in-vehicle apparatus 1 are set as response signals to be transmitted to the roadside unit 3 when a polling signal is received from the roadside unit 3.

Subsequently, at step S130, it is determined whether the road-vehicle communication has been initiated upon reception of the polling signal from the roadside unit 3. If the communication has not been initiated, the same step is repeated. When the road-vehicle communication is established upon reception of the polling signal, the process goes to step S140 where the registration process is executed by following the commands sequentially transmitted from the roadside unit 3.

Outline of the registration process will be described with reference to FIG. 4A. In the road-vehicle communication conducted through the DSRC communication circuit 12, the in-vehicle apparatus 1 replies to the commands transmitted from the roadside unit 3. Usually, the roadside unit 3 repeatedly sends the polling signal, and the communication between the roadside unit 3 and the in-vehicle apparatus 1 starts when the in-vehicle apparatus 1 enters the communication area of the roadside unit 3 and replies to the polling signal.

This first response includes the status information and the authentication number. The status information includes the state of the in-vehicle apparatus 1 and requirements of the in-vehicle apparatus 1. The authentication number is used for two-way authentication process to confirm whether the in-vehicle apparatus 1 is legitimate. However, since the non-registered in-vehicle apparatus 1 is not yet given the official authentication number, the temporary authentication number preset to the in-vehicle apparatus 1 is used.

Figure 4A:
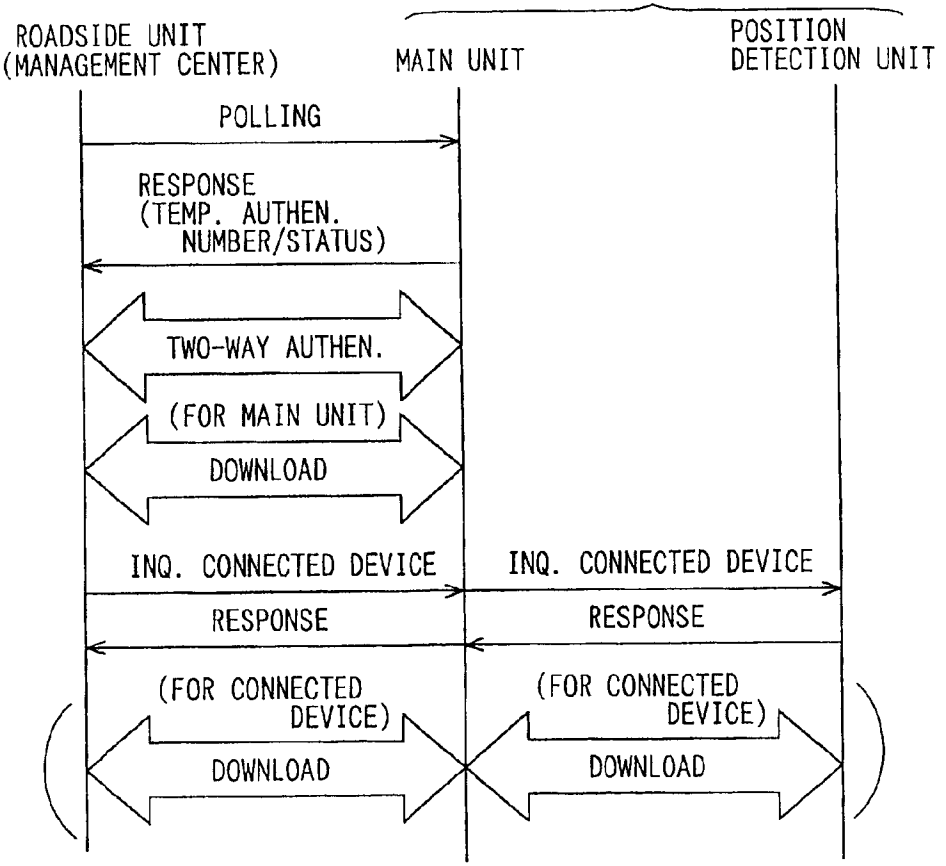
FIG. 4A is a schematic diagram showing a sequence of a registration process through road-vehicle communications.

As illustrated in FIG. 4A, the roadside unit 3, which has received the status information and the temporary authentication number from the in-vehicle apparatus 1, determines that it is necessary to execute the registration process based on the status information and the temporary authentication number. Then, the roadside unit 3 initiates a two-way authentication process using the temporary authentication number. Upon completion of successful two-way authentication, an official authentication number and a registration ID for identifying the in-vehicle apparatus 1 are given to the in-vehicle apparatus 1.

Following this two-way authentication process, the application program is downloaded to the main unit 10, and setup and operation check of the downloaded application are conducted.

At this stage, the roadside unit 3 identifies a type of the main unit 10 based on the status information contained in the response signals to the polling signal. Then, the roadside unit 3 selects and uploads the appropriate application program for the main unit 10 (e.g., for an ERP process, a power supply monitoring process and a card monitoring process and the like). When the operation check for the downloaded application program is completed in the main unit 10, a setup log of this application program is transmitted to the roadside unit 3.

Furthermore, after completion of the download, setup and operation check of the application program of the main unit 10, if the main unit 10 is of the type which is capable of connecting an external device, the roadside unit 3 transmits a command for inquiring a type of a connected device(s) (device connected via the external device interface 11). The main unit 10 of the in-vehicle apparatus 1 runs a connected-device check program included in the application program of the main unit 10. Then, the main unit 10 transmits information indicative of presence or absence of the connected device and a type of the connected device (if any) to the roadside unit 3.

When the roadside unit 3 has confirmed, on the basis of the contents of this response, that the external device which requires the application program is connected to the main unit 10, the application program for the connected device (here, a position detection unit 20) is downloaded to the main unit 10 from the roadside unit 3. Subsequently, setup and operation check of the downloaded application program are also executed.

At this stage, the main unit 10 transfers the data received from the roadside unit 3 (the application program for the connected device, a setup command thereof and an operation check command or the like) to the position detection unit 20 connected to the external device interface 11. The position detection unit 20 executes, based on the transferred data, the process similar to that when the application program of the main unit 10 is downloaded.

Upon completion of the download of the application program of the connected device, the setup of this program and the operation check of this program, the setup data is transmitted to the roadside unit 3, and the registration process is completed.

With this registration process, the data given to the in-vehicle apparatus 1 (e.g., the authentication number, the registration ID) and the data obtained from the in-vehicle apparatus 1 (e.g., type of the main unit 10, type of the connected device, the setup log of the downloaded application program) are transmitted to the management center 5 and are then stored in the user data management unit 52 as the user data.

Returning to FIG. 3, at step S150, the authentication number, the registration ID and the setup log described above are stored in the memory unit 17, and control goes to step S160.

As explained above, when the registration process is completed or when it is determined that the in-vehicle apparatus 1 has been registered to the management center 5 at step S110, the process goes to step S160. At step S160, the status information indicative of the registered state of the in-vehicle apparatus 1 as well as the official authentication number given in the preceding registration step (S140) are set as response signals to be returned to the roadside unit 3 when the polling signal is received from the roadside unit 3.

At the subsequent step S170, each installed application program is started. Then, at step S180, similar to previously described step S130, it is determined whether the road-vehicle communication has been started upon receiving the polling signal from the roadside unit 3. If it is not, the same step is repeated. On the other hand, when the road-vehicle communication is started upon receiving the polling signal, the process goes to step S190. At step S190, ordinary processes, such as a process of transmitting the user data (toll charging data, monitor data or the like) and a process of updating the system data (the application program and the toll charging data or the like), are executed by following the commands sequentially transmitted from the roadside unit 3. Then, the process returns to step S180.

Figure 4B:
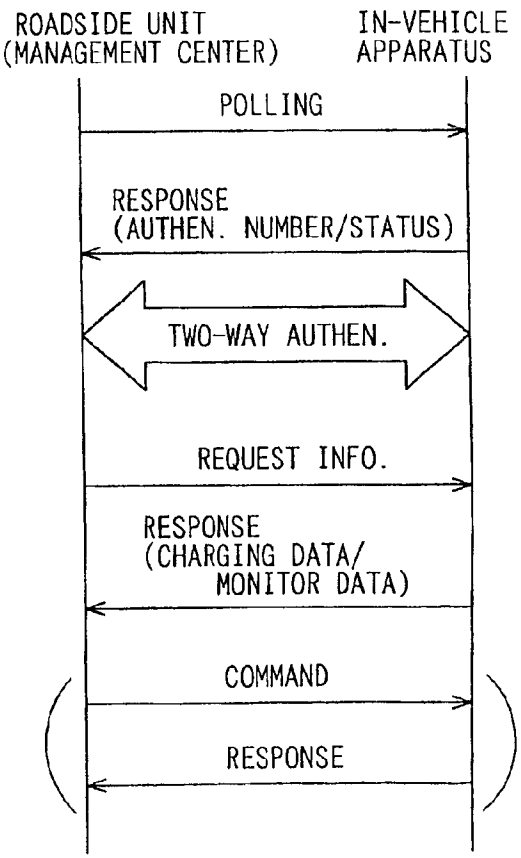
FIG. 4B is a schematic diagram showing a sequence of an ordinary process through road-vehicle communications.

Here, the ordinary processes will be explained with reference to FIG. 4B. The roadside unit 3, which has received the status information and the authentication number from the in-vehicle apparatus 1, determines that the current process is the ordinary process based on the received status information and the authentication number and executes the two-way authentication using the authentication number.

Upon successful completion of the two-way authentication, a command for executing a selected process, which is selected based on the status information, is transmitted to the in-vehicle apparatus 1. Here, by way of example, it is assumed that the in-vehicle apparatus 1 executes the application program, so that the user data (charging data and monitor data) are formed and are then transmitted to the management center 5 through the road-vehicle communication. Thus, the status information is set to "TRANSMISSION REQUESTED". Corresponding to this status information, the roadside unit 3 transmits an "Information request command" to the in-vehicle apparatus 1. In response to this, the in-vehicle apparatus 1 transmits the user data generated in the in-vehicle apparatus 1. Such exchange of command between the roadside unit 3 and the in-vehicle apparatus 1 is repeated as many times as required based on the status information. The user data transferred to the management center 5 is processed in the maintenance control unit 53 (monitor data) and the toll charge control unit 54 (toll charging data and monitor data).

Figure 5:
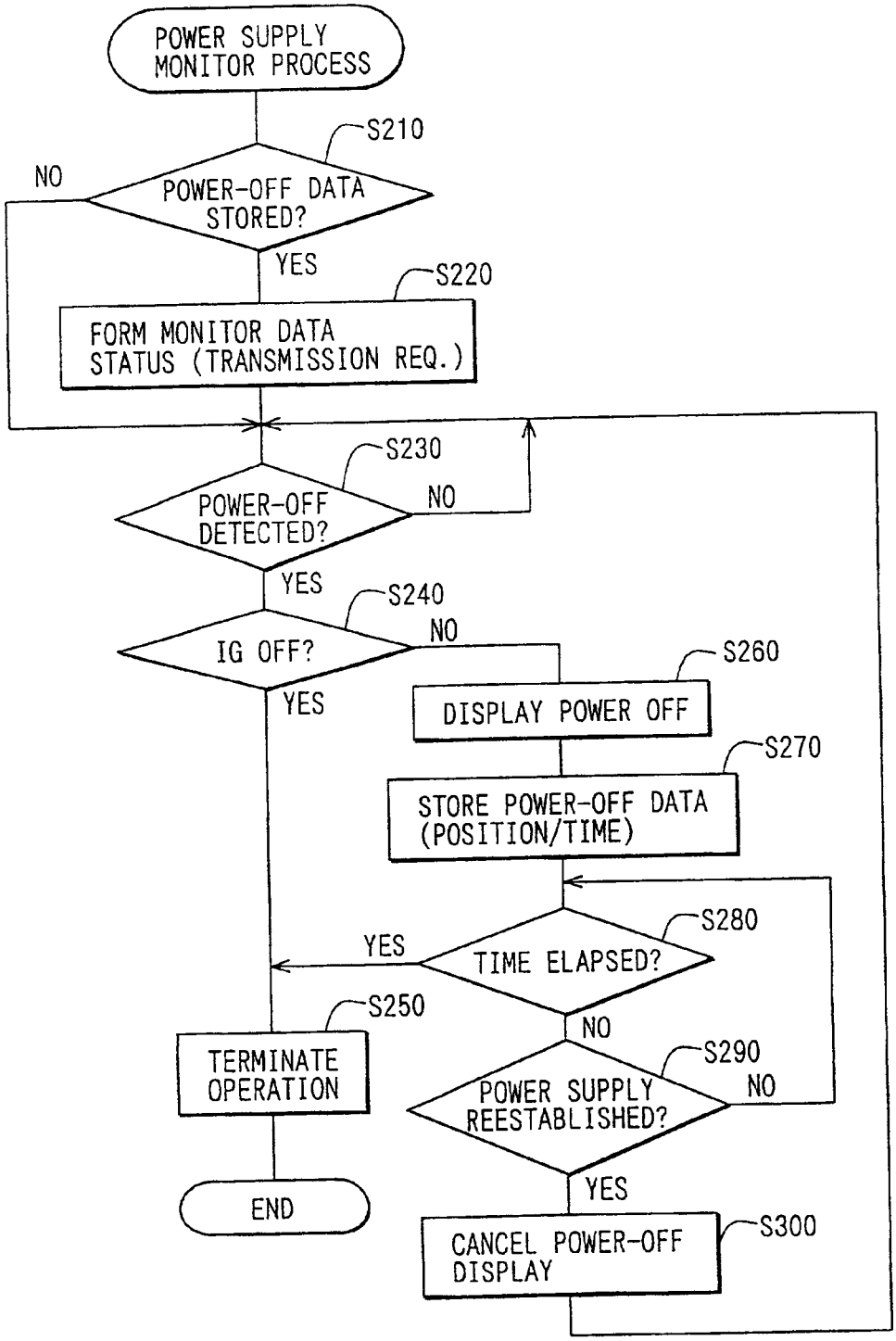
FIG. 5 is a flowchart showing a power supply monitoring process.
Figure 6:
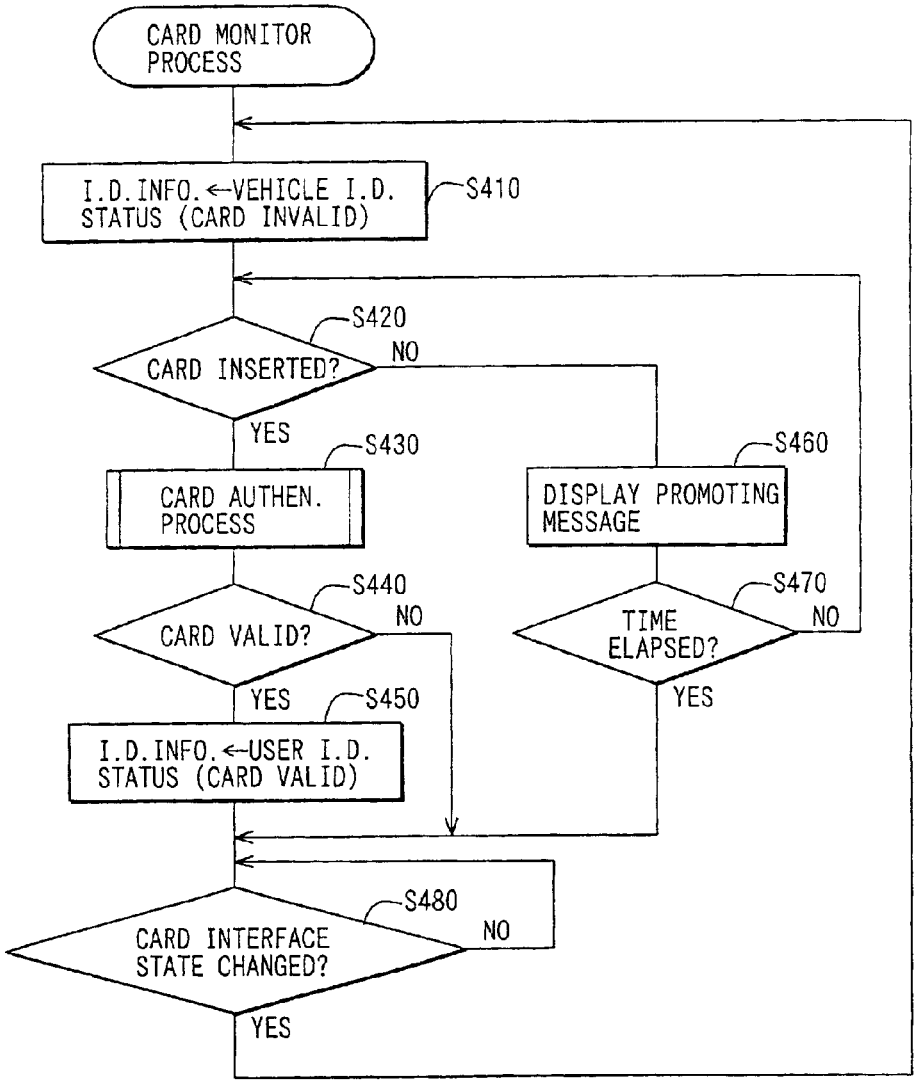
FIG. 6 is a flowchart showing a card monitoring process.

Next, various processes (i.e., the power supply monitor process, the IC card monitor process and the ERP process) executed by the downloaded application program in the in-vehicle apparatus 1 will be described with reference to FIGS. 5 to 7.

First, the power supply monitor process will be explained. As illustrated in FIG. 5, when this process is initiated, it is first determined whether power-off data is stored in the memory unit 17 at step S210. When the power supply to the main unit 10 is turned off while an ignition (IG) switch is switched on, there is generated the power-off data indicative of the position of the in-vehicle apparatus 1 and the time at which the power supply from the vehicle battery to the main unit 10 is turned off (hereinafter referred to as the position and time of the power-off event). If the power-off data is not stored in the memory unit 17, it is determined that the previous operation of the main unit 10 is finished in a normal manner, and control proceeds to step S230. On the other hand, if the power-off data is stored in the memory unit 17, control moves to step S220. At step S220, the monitor data is generated based on the power-off data, and the status information is set to "TRANSMISSION REQUESTED". Then, control moves to step S230.

Thereby, when the vehicle M enters the communication area of the roadside unit 3, the monitor data generated at step S220 is transmitted to the management center 5 via the roadside unit 3 through the road-vehicle communication.

At step S230, it is determined whether the turning off of the power supply from the vehicle battery to the main unit 10 is detected. If it is not, the same step is repeated. The turning off of the power supply can be detected upon receiving a detected signal outputted from the power supply circuit 16 when the power source of the main unit 10 is switched from the vehicle battery to the internal battery 15 upon turning off of the power supply from the vehicle battery.

When the turning off of the power supply from the vehicle battery to the main unit 10 is detected, control goes to step S240 where it is determined whether the IG switch has been turned off. If the IG switch has been turned off, it is determined that the turning off of the power supply is carried out in the normal manner. Then, control moves to step S250 where the operation of the main unit 10 is terminated in a normal manner, and the power supply monitor process ends.

Even when the IG switch is turned off, and the power supply from the vehicle battery to the main unit 10 is turned off, the power is still supplied to the main unit 10 from the internal battery 15. Thus, at step 250, there is carried out an operation for storing necessary data in the memory unit 17 until the power supply to the mobile unit 10 from the vehicle battery is recovered.

On the other hand, if it is determined that the IG switch has not been turned off at step 240, the current condition is regarded as an abnormal condition caused by a malfunction or illegal operation. Then, control moves to step 260 where a message that informs the turning off of the power supply from the vehicle battery is displayed on the display unit 14.

At the subsequent step S270, the measured position data (position/time) is obtained from the position detection unit 20 and is then stored in the RAM, which is the component of the control microcomputer 18, as the power-off data. In the subsequent step S280, it is determined whether a predetermined time period has elapsed after the time of detecting the turning off of the power supply from the vehicle battery. If the predetermined time period has not elapsed, control goes to step S290 where it is determined whether the power supply from the vehicle battery to the main unit 10 is reestablished.

If the power supply has not been reestablished, control returns to step S280. If the power supply has been reestablished, control moves to step S300 where the message that informs the turning off of the power supply from the vehicle battery is canceled on the display unit 14. Then, control returns to step S230.

On the other hand, if it is determined that the predetermined time period has elapsed at step S280, control goes to step S250. At step S250, the operation of the main unit 10 is terminated in the normal manner as described above. At this stage, the power-off data previously stored in the RAM is transferred to and stored in the memory unit 17. Thus, when this power supply monitor process is executed next time, the power-off data is processed into the monitor data through steps S210 and S220 and is then transferred to the management center 5 through the road-vehicle communication.

That is, in this power supply monitor process, while the IG switch is turned on, if the power supply from the vehicle battery to the main unit 10 is turned off for a time period greater than the predetermined time period, it is determined that the abnormal condition has occurred. Thus, the power-off data indicative of the position and time of the power-off event is stored. Thereafter, when the road-vehicle communication is established, the power-off data is transmitted to the management center 5 as the monitor data.

Next, the IC card monitor process will be explained. As is illustrated in FIG. 6, when this process is initiated, "the vehicle ID", which is the intrinsic number of each in-vehicle apparatus 1 assigned to the vehicle at the time of manufacture, is set as the identification information, and "CARD INVALID" is set as the status information. Next, at step S420, it is determined whether the IC card 30 is inserted in the card interface 13.

When the IC card 30 is inserted in the card interface 13, control goes to step S430 to execute a card authentication process. In the following step S440, it is determined whether the IC card 30 is valid for the present system.

If the IC card 30 is invalid, control moves to step S480. If the IC card 30 is valid, control moves to step S450. At step S450, the "user ID" read from the IC card 30 is set as the identification information, and "CARD VALID" is set as the status information. Thereafter, control moves to step S480.

Moreover, if it is determined that the IC card 30 has not been inserted in the card interface 13, control proceeds to step S460. At step S 460, an insertion-promoting message, which asks the user to insert the IC card 30 in the card interface 13, is displayed on the display unit 14.

Then, in the following step S470, it is determined whether a predetermined time period has elapsed after the time of displaying the insertion-promoting message. If the predetermined time period has not elapsed, control returns to step S420, thereby waiting the insertion of the IC card 30. If the predetermined time period has elapsed, it is determined that the IC card 30 will not be inserted, and control moves to step 480.

At step S480, the same step is executed repeatedly to monitor the card interface 13. When a state of the card interface 13 changes, control moves to step S410 to repeat steps S410 to S470 as explained above.

Specifically, when the IC card 30 is inserted in the card interface 13, the user ID recorded in the IC card 30 is used as the identification information for identifying the user who receives the service. When the IC card 30 is not inserted in the card interface 13 (this state is referred to as a non-inserted state of the card interface 13), the vehicle ID intrinsic to the in-vehicle apparatus 1 is used as the identification information in place of the user ID.

Next, the ERP process, which is one of the charging processes, will be explained.

Here, it is assumed that the connected-device check program has been installed in the position detection unit 20 in the previous registration process. Based on the program downloaded for the position detection unit 20, the position detection unit 20 conducts the following procedure. That is, the position detection unit 20 generates the measured position data periodically based on the signals received from the GPS antenna A. Then, upon receiving a request for transmitting the measured position data from the main unit 10, the position detection unit 20 transmits the measured position data to the main unit 10. When the position detection unit 20 detects an event of disconnection of the communication between the position detection unit 20 and the main unit 10, the position detection unit 20 stores the measured position data in the memory unit 24 as history data. Once the communication between the position detection unit 20 and the main unit 10 is restored, the position detection unit 20 transmits the history data to the main unit 10.

The above process is repeated at predetermined time intervals after the application is started at step S170.

Figure 7:
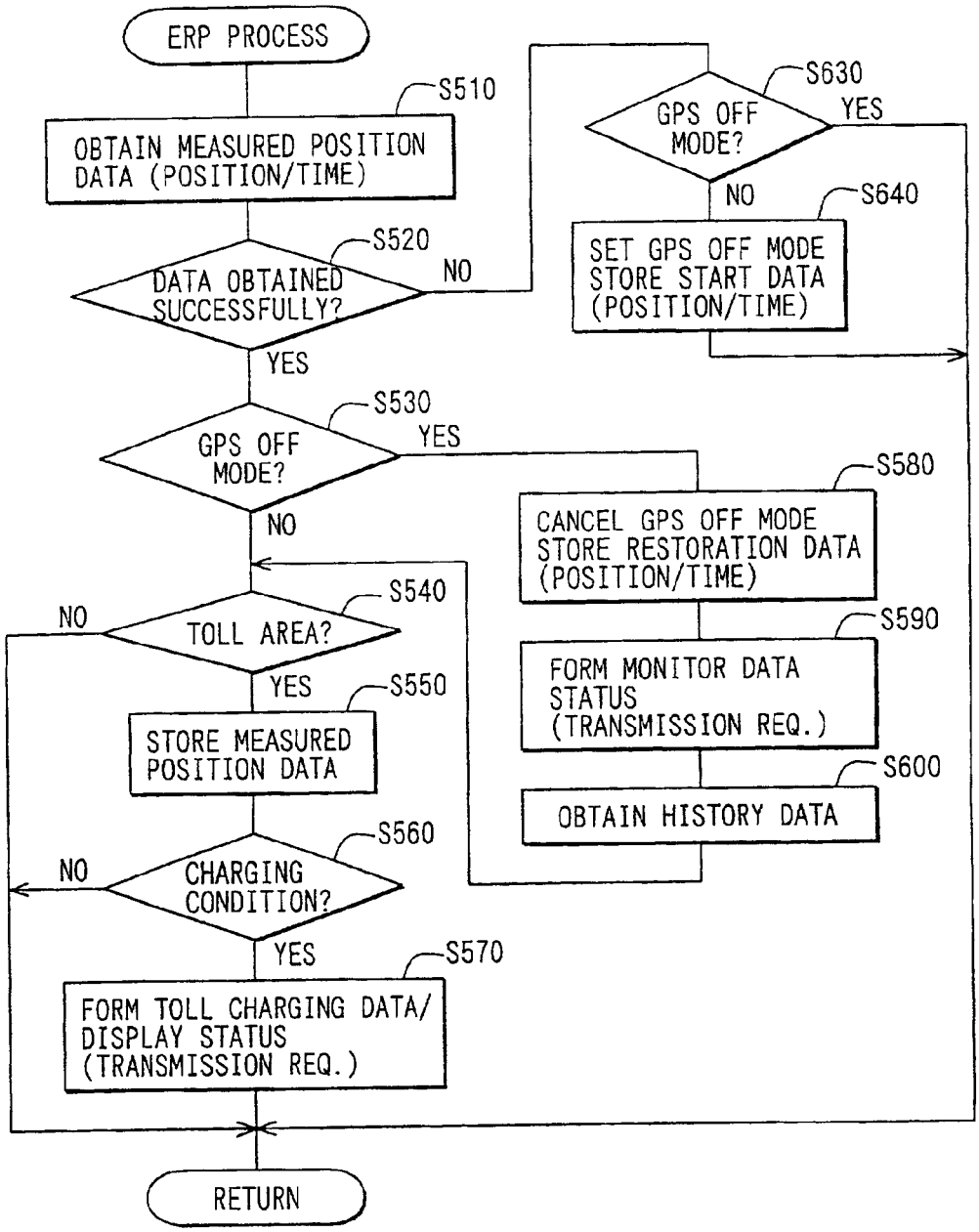
FIG. 7 is a flowchart showing an ERP process.

As illustrated in FIG. 7, when this process is started, the measured position data is obtained at step S510 by transmitting a command to the position detection unit 20. In the subsequent step S520, it is determined whether the measured position data has been obtained successfully. When it is obtained successfully, control goes to step S530 where it is determined whether the operation mode is set to a "GPS OFF mode".

If the current operation mode is not the "GPS OFF mode", control goes to step S540. At step S540, it is determined whether the vehicle M is located within a toll area based on the toll area data obtained by the download operation and the measured position data obtained at step S510. If the vehicle is not within the toll area, this process ends.

On the other hand, if it is determined that the vehicle M is located within the toll area at step S540, control goes to step S550 where current measured position data is stored. At the subsequent step S560, it is determined whether the current running state of the vehicle M satisfies the toll charging condition. If it does not, the process ends.

For example, the toll charging condition can be as follows. That is, the toll may be charged when the vehicle enters the toll area, when presence of the vehicle within the toll area exceeds each predetermined time period, when the vehicle enters each different section within the toll area (for instance, the toll may increase as the vehicle approaches the center of the downtown). Alternatively, the toll may be charged depending on time of the day at which the vehicle stays within the toll area. Furthermore, the toll may be charged by any combination of the above conditions. More specifically, the toll charging condition can be selected based on the purpose of the ERP system.

At step S560, if it is determined that the current running state of the vehicle M satisfies the toll charging condition, control goes to step S570. At step S570, toll charging data is formed to collect a toll based on the toll charging condition and is displayed on the display unit 14, and the status is changed to "TRANSMISSION REQUESTED", so that the toll charging data can be transmitted to the management center 5 through the road-vehicle communication. Then, the process ends.

The toll charging data includes toll information, the identification information and route information. The toll information indicates a toll to be collected and is determined based on the toll charging condition. The identification information is set in the preceding IC card monitor process (namely, the user ID read from the IC card 30 is used as the identification information if the IC card 30 is inserted in the card interface 13, and the vehicle ID is used as the identification information if the IC card 30 is not inserted in the card interface 13). The route information includes the measured position data used as the base for computing the toll.

Once the road-vehicle communication between the vehicle M and the roadside unit 3 is initiated, the toll charge control unit 54 of the management center 5, which has received the toll charging data, checks legitimacy of the charging information based on the route information. If the legitimacy is confirmed, the toll charge control unit 54 executes the procedures for actually collecting the toll based on the identification information. More specifically, if the user ID is set as the identification information, the toll is collected or withdrawn from a bank account linked to the user ID. If the vehicle ID is set as the identification information, the toll is charged to an owner of the vehicle having the in-vehicle apparatus 1, or a warning is issued to the owner to notify the fact that the IC card 30 has not been inserted in the card interface 13 through any appropriate manner (e.g., through a mail).

If acquisition of the measured position data from the position detection unit 20 fails at step S520, control goes to step S630. At step S630, it is determined whether the current operation mode is the "GPS OFF mode". If the current operation mode is not the "GPS OFF mode", control goes to step S 640. Since the communication with the position detection unit 20 has been disabled, it is determined that the abnormal condition that disables such communication has occurred. Thus, at step S640, the operation mode is set to the "GPS OFF mode", and the latest measured position data obtained from the position detection unit 20 is stored as start data. Then, the process ends.

At step S630, if it is determined that the current operation mode is "GPS OFF mode", it is assumed that the abnormal condition still exists, and the process ends.

At step S530, if it is determined that the current operation mode is the "GPS OFF mode", control goes to step S580. Since the communication with the position detection unit 20 has been enabled, it is assumed that the abnormal condition is changed to the normal condition that allows the communication with the position detection unit 20. Thus, at step S580, the "GPS OFF mode" is cancelled, and the measured position data obtained at step S510 is stored as restoration data.

In the subsequent step S590, the monitor data, which includes both the start data stored at step S640 and the restoration data stored at step S580, is formed, and the status information is set to "TRANSMISSION REQUESTED", so that the monitor data can be transmitted to the management center 5 through the road-vehicle communication.

At step S600, the history data, which has been stored while the operation mode is the "GPS OFF mode", is obtained from the position detection unit 20. Then, control goes to step S540.

In the previous description, the operations at steps 540 to 570 are carried out only on the measured position data obtained at step S510. However, when control moves from S600 to S540, the operations are carried out on all the position data including both the measured position data obtained at step S510 and the history data obtained at step S600.

That is, even if the abnormal condition (GPS OFF mode), which disables the communication between the main unit 10 and the position detection unit 20, occurs during this process, the toll can be correctly charged based on the history data. Furthermore, a start position, start time, a restoration position and restoration time are also notified to the management center 5. The start position is the position or location of the in-vehicle apparatus 1 at which the abnormal condition starts. The start time is the time point at which the abnormal condition starts. The restoration position is the position or location of the in-vehicle apparatus 1 at which the abnormal condition is removed. The restoration time is the time point at which the abnormal condition is removed.

In the present embodiment, steps S510 and S540–S570 constitute a toll charge control means of the present invention. Steps S230, S240, S420–S440, S530 and S630 constitute an abnormal condition detecting means of the present invention. Steps S210, S220, S270, S410, S640, S580 and S590 constitute a monitor control means of the present invention. Step S140 constitutes a program acquiring means of the present invention.

As explained above, in the automatic toll charging system of the present embodiment, the in-vehicle apparatus 1 obtains the application program required for receiving the automatic toll charging service from the management center 5 by downloading this program through the road-vehicle communication. Moreover, the management center 5 stores the information of the in-vehicle apparatus 1, which has conducted the download, as the user data (e.g., a type of the main unit 10, presence of any connected-device, a type of such a connected-device, a setup log of the downloaded application program).

Therefore, according to the automatic toll charging system of this embodiment, the management center 5 can accurately detect the in-vehicle apparatus 1 under the operation and can also prevent use of the in-vehicle apparatus 1 having an illegal application program installed therein.

In addition, if the abnormal condition occurs in the in-vehicle apparatus 1, the current state of the in-vehicle apparatus 1 is compared with the user data (e.g., an apparatus configuration, a setup log or the like) stored in the management center 5 to see whether an illegal operation has been conducted on the in-vehicle apparatus 1 and/or the program installed in the in-vehicle apparatus 1.

Moreover, in the automatic toll charging system of the present embodiment, if the abnormal condition (power supply OFF, GPS OFF or the like) occurs, the monitor data is generated from the measured position data that indicates the start position/time (GPS OFF mode start data, power supply OFF data) or the restoration position/time (restoration data of the GPS OFF mode). Then, the generated monitor data is transmitted to the management center 5.

Therefore, with use of the automatic toll charging system of this embodiment, the management center 5 can detect the occurrence of the abnormal condition of the in-vehicle apparatus 1. When the abnormal condition of the in-vehicle apparatus 1 is detected, the management center 5 can still collect the toll to be charged or can impose a penalty, such as a warning, a fine or prohibition of use of the in-vehicle apparatus 1, on the user (owner) of the in-vehicle apparatus 1 that has shown many repeated abnormal conditions. Thus, it is possible to prevent the illegal operations on the in-vehicle apparatus 1.

Moreover, in the automatic toll charging system of this embodiment, when the IC card 30, which stores the user ID as the identification information to identify the charging object, is not inserted in the card interface 13, the vehicle ID, which is intrinsic to the in-vehicle apparatus 1, is used as the identification information. Thus, it is possible to charge the toll to a purchaser of the in-vehicle apparatus 1 identified with the vehicle ID or to the owner of the vehicle to which the in-vehicle apparatus 1 is installed, thereby assuring reliable collection of the toll.

Moreover, in this embodiment, the status information included in the response signal, which is transmitted in reply to the polling signal, indicates whether the IC card 30 is inserted in the card interface 13. Thus, the roadside unit 3 can immediately identify an illegal vehicle that has the in-vehicle apparatus 1 to which the IC card 30 has not been inserted based on the response signal. Therefore, for example, when the charging process in the ETC is possible with the in-vehicle apparatus 1, a countermeasure for the illegal vehicle, such as a blockade of the tollgate for blocking the vehicle M that is now trying to pass through the tollgate, can be reliably and quickly executed.

Figure 8:
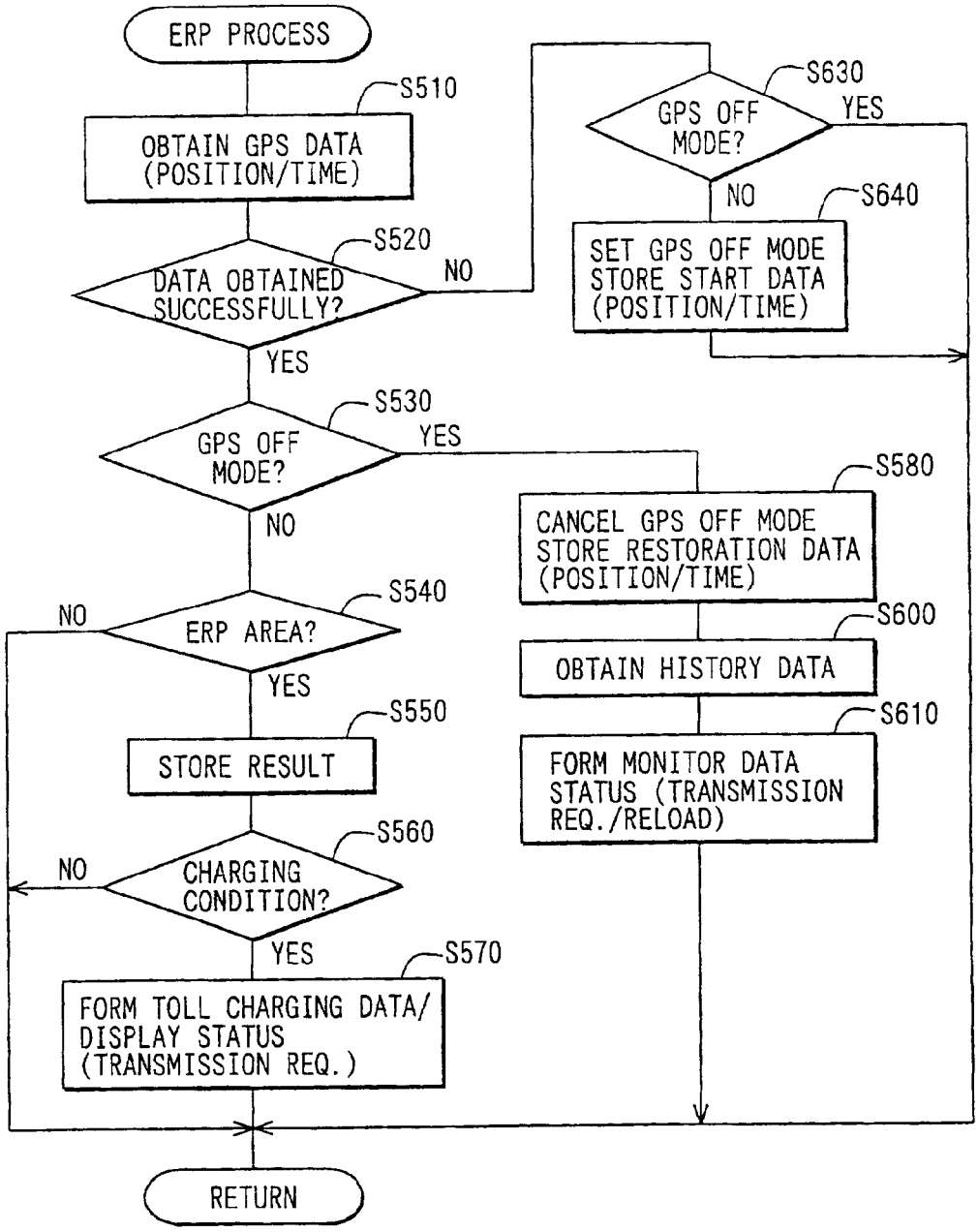
FIG. 8 is a flowchart showing a modification of the ERP process shown in FIG. 7.

In this embodiment, when the in-vehicle apparatus 1 is recovered from the GPS OFF mode (S530-YES), the monitor data including the start data of the GPS OFF mode and the restoration data of the GPS OFF mode are generated (S580, S590) and are then transmitted to the management center 5, and the toll charging data for the period of the GPS OFF mode is generated in the in-vehicle apparatus 1 based on the history data stored in the position detection unit 20 (S600, S540–S570). Alternatively, as shown in FIG. 8, the monitor data can be formed from the start data, the restoration data and the history data (S580, S600, S630) and can be transmitted to the management center 5. Then, the management center 5 can determine whether the toll should be charged to the in-vehicle apparatus 1.

Moreover, the status information included in the response signal to the polling signal can include a version information of the currently used system data (e.g., toll area data, toll charging condition data, application program). In this way, if the system data has been modified, the roadside unit (or management center 5) can detect the modification of the system data by checking the status information. As a result, it is possible to redownload the system data to all of the in-vehicle apparatuses 1 located within the toll area at once in a simple and effective manner within a short period of time.

Moreover, the in-vehicle apparatus 1 may be modified to obtain the information from an electronic control unit (ECU) or the like through an in-vehicle LAN system. In this case, the toll can be additionally or separately charged based on an engine operating time period, the amount of exhaust gas and/or the like. In this way, the amount of the exhaust gas exhausted from the vehicles can be reduced, thereby improving the environment.

In this embodiment, the application program (for executing the power supply monitor process, the IC card monitor process, the ERP process) is downloaded through the road-vehicle communication. However, the application program can be initially installed in the in-vehicle apparatus 1 as a non-modifiable application program, and modification of the toll area data, the toll charging condition data and the like can be allowed. Alternatively, the application program can be initially installed in the in-vehicle apparatus 1 as a modifiable application program that can be updated by downloading a new corresponding application program.

Moreover, in this embodiment, the application program is downloaded to the position detection unit 20. However, the position detection unit 20 can be modified to have a main program that outputs measured position data upon receiving a corresponding command from the main unit 10. Furthermore, the position detection unit 20 can receive the power from the main unit 10.

The main unit 10 can be any commercially available known in-vehicle apparatus that can conduct an automatic charging system through the ETC system. In this case, this in-vehicle apparatus needs to be able to download the application program through the road-vehicle communication with the roadside unit 3 and needs to have an external device interface that can be connected to the position detection unit 20 of the above embodiment. Thus, the user of the in-vehicle apparatus can also use the in-vehicle apparatus for the automatic toll charging through the ERP system by adding the minimum required arrangement (position detection unit 20).

Moreover, in this embodiment, the DSRC communication circuit 12 is used to communicate with the management center 5. However, as indicated by a dotted line in FIG. 2, the two-way communication may be realized through a cellular phone 40 (or any other wireless telephone, such as a personal handy-phone systems (PHS) phone, an automobile telephone or the like) by connecting the cellular phone 40 to the external device interface 11.

Figure 9:
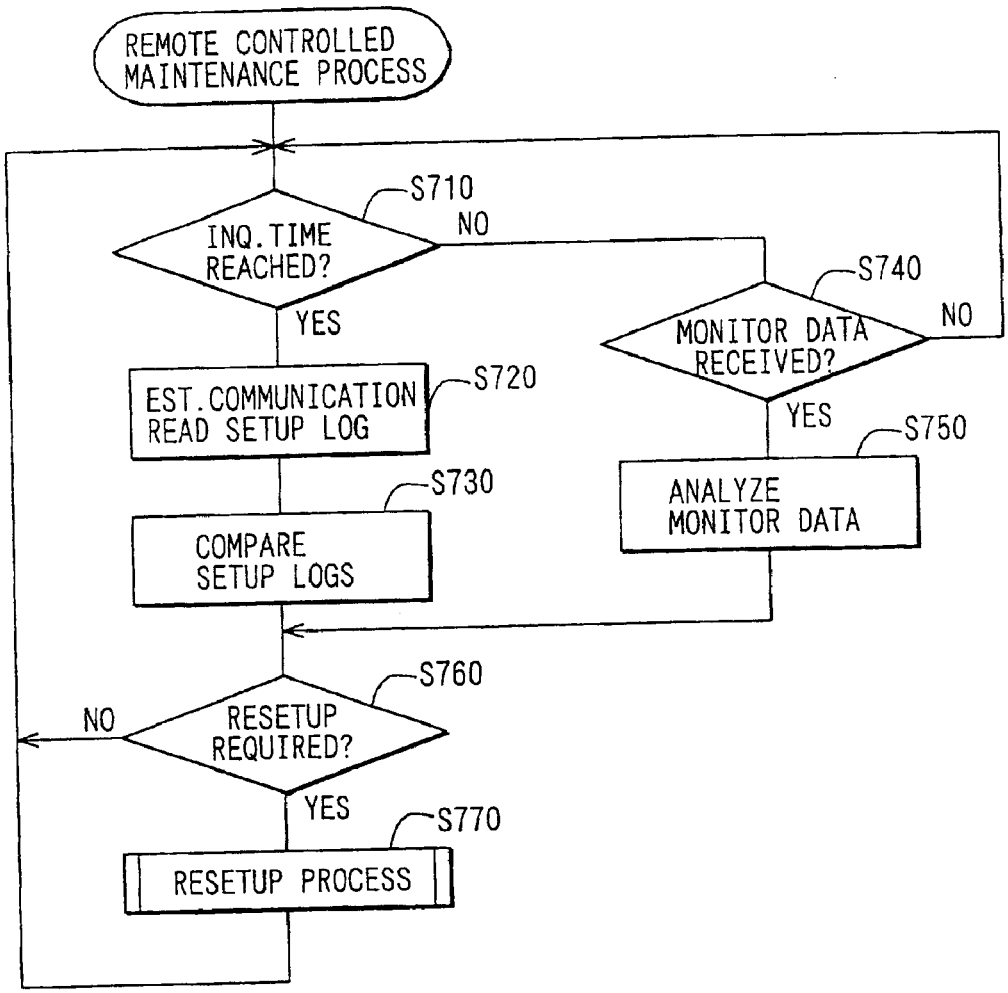
FIG. 9 is a flowchart showing a remote-controlled maintenance process to be executed at a control center.

In this case, a remote-controlled maintenance process can be carried out through the maintenance control unit 53 of the management center 5. Details of remote-controlled maintenance process will be described with reference to FIG. 9.

At step S710, it is determined whether a predetermined inquiry time has been reached. If the predetermined inquiry time has been reached, control goes to step S720. At step S720, the maintenance control unit 53 of the management center 5 establishes a communication with the cellular phone 40 connected to the in-vehicle apparatus 1 and reads a setup log stored in the memory unit 17 of the main unit 10.

Next, at step S730, the setup log of the in-vehicle apparatus 1 read at step S720 is compared with the setup log stored in the user data management unit 52 of the management center 5. Then, control goes to step S760.

If it is determined that the predetermined inquiry time has not been reached at step S710, control moves to step S740. At step S740, it is determined whether the monitor data has been received from the in-vehicle apparatus 1 through the road-vehicle communication. If it has not, control returns to step S710. On the other hand, if it is determined that the control data has been received from the in-vehicle apparatus 1, control moves to step S750 where the monitor data is analyzed. Then, control goes to step S760.

At step S760, upon completion of the comparison at step S730, if the setup logs coincide with each other or if it cannot be determined that the illegal operation is conducted on the in-vehicle apparatus 1, control returns to step S710. On the other hand, if the setup logs do not coincide with each other or if it is determined that the illegal operation is conducted on the in-vehicle apparatus 1, control proceeds to step S770. At step S770, a resetup process for downloading the system data to the in-vehicle apparatus 1 through the cellular phone 40 or the roadside unit 3 is conducted. Then, control returns to step S710.

As described above, when the cellular phone 40 is connected to the in-vehicle apparatus 1, the state of the in-vehicle apparatus 1 can be monitored periodically, so that the illegal operation can be detected immediately.

The in-vehicle apparatus 1 can be modified to disable the execution of the downloaded application when the monitor data is generated. Furthermore, the management center 5 can be modified to execute the resetup process whenever the monitor data is received.

In the above case, each one of the processes corresponding to the monitor control means is equivalent to a reacquisition control means.

(Second Embodiment)

Next, a second embodiment of the present invention will be explained with reference to FIG. 10.

The second embodiment is similar to the first embodiment except few differences, so that only the differences will be described below.

Figure 10:
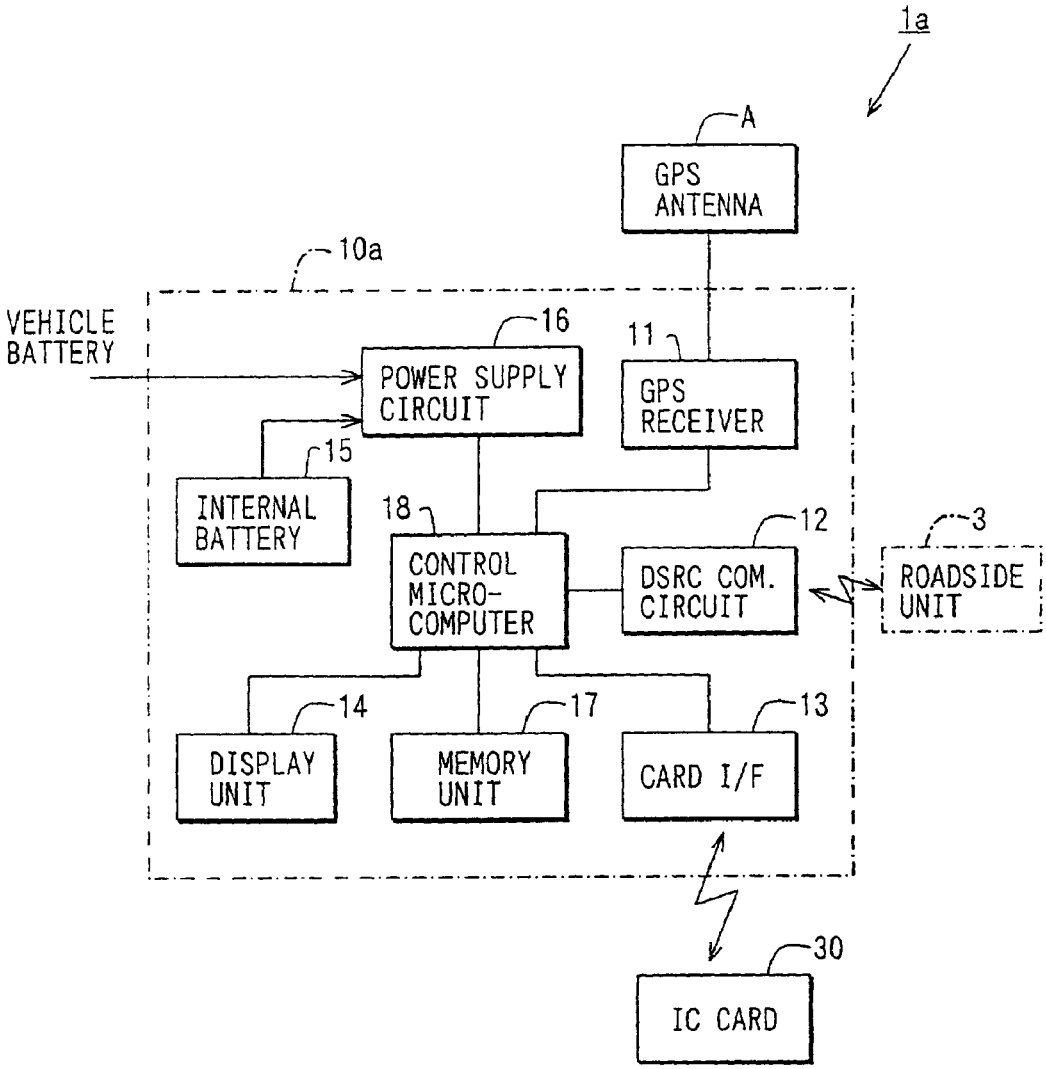
FIG. 10 is a block diagram illustrating a structure of an in-vehicle apparatus according to a second embodiment.

As shown in FIG. 10, an in-vehicle apparatus 1*a* of the present embodiment only includes a main unit 10*a*, and a GPS receiver 11 is provided in place of the external device interface 25 of the main unit 10 of the first embodiment.

In this case, the "GPS OFF mode" of the first embodiment does not exist, so that an ERP process of the second embodiment is similar to that of the first embodiment except that steps S520, S530 and S580–S620 are omitted from the ERP process. Thus, in the second embodiment, functions and advantages similar to those of the first embodiment can be achieved.

In the second embodiment, although the GPS receiver 11 is provided in place of the external interface 25, it is possible to provide the external interface 25 in the main unit 10*a*.

(Third Embodiment)

Figure 11:
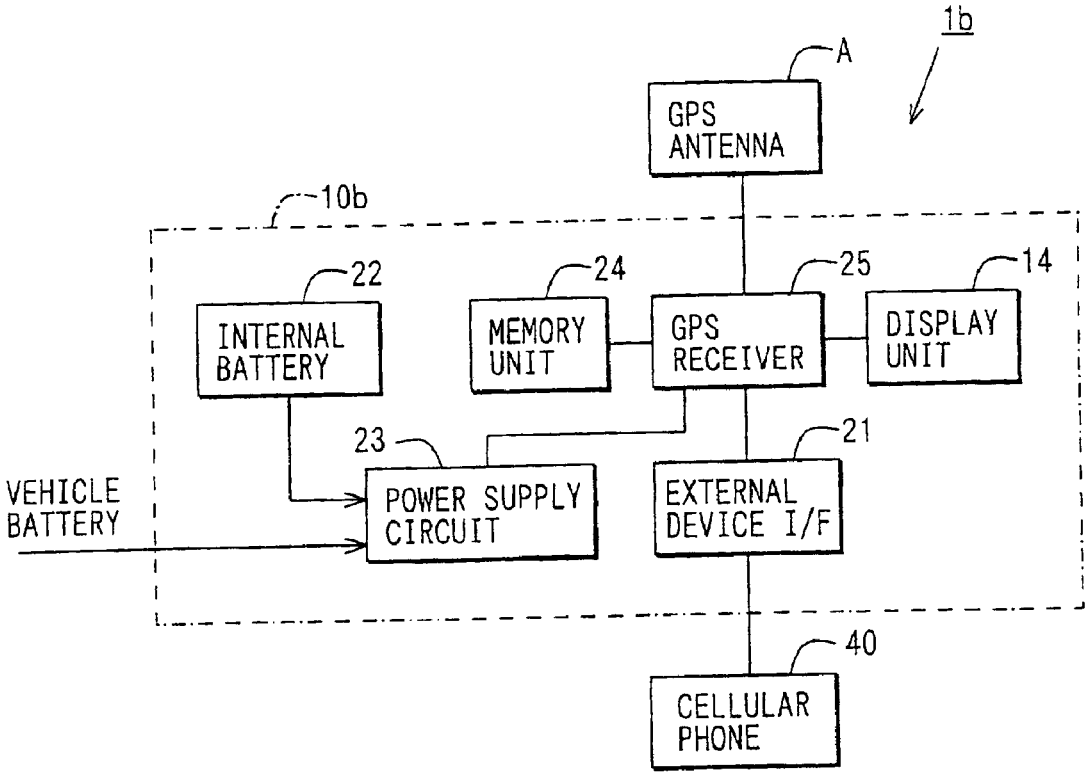
FIG. 11 is a block diagram illustrating a structure of an in-vehicle apparatus according to a third embodiment.

A third embodiment of the present invention will be explained with reference to FIG. 11.

The third embodiment is similar to the first embodiment except few differences, so that only the differences will be described below.

An in-vehicle apparatus 1*b* of the present embodiment only includes a main unit 10*b*. The main unit 10*b* of the third embodiment is similar to the position detection unit 20 of the first embodiment except that the main unit 10*b* further includes a display unit 14. The cellular phone 40 is connected to the external device interface 21.

Thus, in the in-vehicle apparatus 1*b* of the third embodiment, the communication (download and update of the system data, transmission of the toll charging data and the monitor data) is performed through the cellular phone 40.

In this case, since the user to be charged can be identified with a telephone number of the cellular phone 40, it is also possible to bill and collect the toll along with a telephone bill of the cellular phone 40.

That is, in the first embodiment, the various functions of the ERP system is embodied by modifying the in-vehicle apparatus of the ETC system, which is capable of downloading the application program and has the interface to the external device(s). Similarly, in the third embodiment, the various functions of the ERP system is embodied by modifying the in-vehicle apparatus of the GPS system, which is capable of downloading the application program and has the interface to the external device(s).

In the third embodiment, the main unit 10*b* acts as a main unit of the present invention, and the cellular phone acts as a communication unit of the present invention. Furthermore, the external device interface 21 acts as a second interface means of the present invention.

(Fourth Embodiment)

Figure 12:
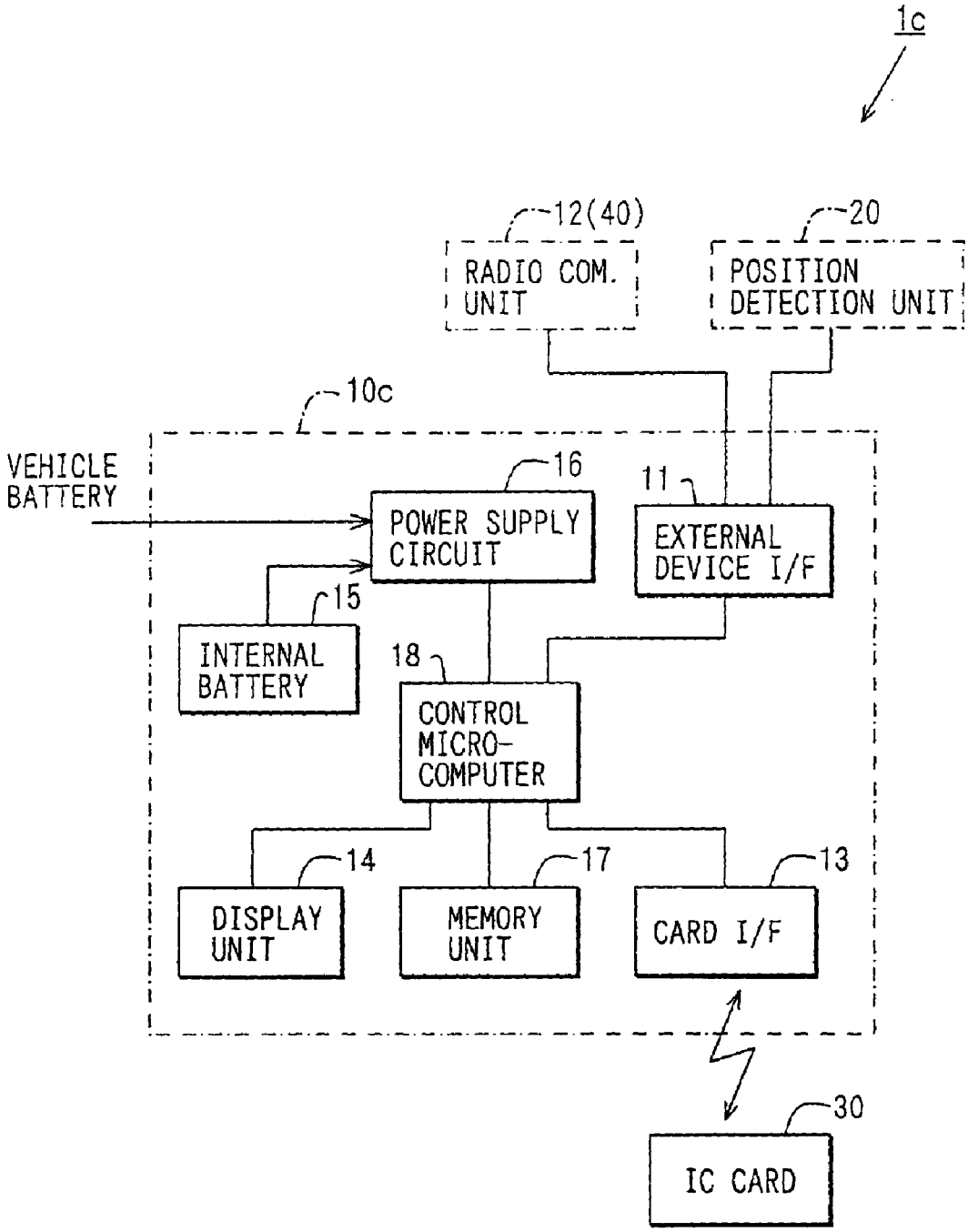
FIG. 12 is a block diagram illustrating a structure of an in-vehicle apparatus according to a fourth embodiment.

A fourth embodiment of the present invention will be explained with reference to FIG. 12.

The fourth embodiment is similar to the first embodiment except few differences, so that only the differences will be described below.

An in-vehicle apparatus 1*c* according to the fourth embodiment includes a main unit 10*c*, a position detection unit 20 and a radio communication unit 12 (or 40).

The position detection unit 20 of the fourth embodiment is substantially the same as the position detection unit 20 of the first embodiment. The main unit 10*c* of the fourth embodiment is similar to the main unit 10 of the first embodiment except that the DSRC communication circuit 12 is omitted from the main unit 10.

The radio communication unit can be similar to the DSRC communication circuit 12 that constitutes the main unit 10 of the first embodiment or can be the cellular phone 40. The radio communication unit is connected to the external device interface 11 of the main unit 10*c*.

With use of the in-vehicle apparatus 1*c* of the fourth embodiment, it is possible to achieve functions and advantages similar to those of the first embodiment. If the user already has the position detection unit 20 and/or the radio communication unit, the position detection unit 20 and/or the radio communication unit can be used to provide the apparatus that can conduct the automatic toll charging process of the ERP system.

In each one of the above embodiments, although the display unit 14 and the card interface 13 are integrated in the main unit, it is not necessary to integrate these components in the main unit. For example, the display unit 14 and the card interface 13 can be provided separately from the main unit and can be connected to the main unit through the external device interface 11.

Additional advantages and modifications will readily occur to those skilled in the art. The invention in its broader terms is therefore, not limited to the specific details, representative apparatus, and illustrative examples shown and described.

What is claimed is:

1. An in-vehicle apparatus comprising:

a position and time measuring means that measures a current position of a vehicle and current time;

a communication means that communicates with an external management apparatus to exchange various information through wireless communication;

a toll charge control means that determines a running state of said vehicle based on measurements of said position and time measuring means and forms toll charging data if said running state of said vehicle satisfies a predetermined toll charging condition, said toll charge control means transmitting said toll charging data to said management apparatus through said communication means, said toll charging data including at least toll information and object identification information, said toll information indicating a toll determined based on said toll charging condition, said object identification information identifying an object to be charged said toll;

an abnormal condition detecting means that detects an abnormal condition in said in-vehicle apparatus; and a monitor control means that forms monitor data when said abnormal condition is detected by said abnormal condition detecting means and transmits said monitor data to said management apparatus through said communication means, said monitor data including at least apparatus identification information, said current position of said vehicle and said current time measured by said position and time measuring means when said abnormal condition is detected, said apparatus identification information identifying said in-vehicle apparatus.

2. An in-vehicle apparatus according to claim 1, further comprising an information reading means for reading information from a recording medium that stores said object identification information, wherein said abnormal condition detecting means detects a non-inserted state of said information reading means as said abnormal condition.

3. An in-vehicle apparatus according to claim 1, further comprising:

an auxiliary power supply means that supplies power to said in-vehicle apparatus for a limited time period when power supply for operating said in-vehicle apparatus from an external power source is turned off; and a monitor data storing means that stores said monitor data formed by said monitor control means, wherein:

said abnormal condition detecting means detects initiation of power supply from said auxiliary power supply means as said abnormal condition; and said auxiliary power supply means continuously supplies said power at least until said monitor data formed by said monitor control means is stored in said monitor data storing means.

4. An in-vehicle apparatus according to claim 1, wherein:

said communication means constitutes a communication unit;

the rest of said in-vehicle apparatus other than said communication means constitutes a main unit; and said communication unit is detachably connected to said main unit.

5. An in-vehicle apparatus according to claim 1, wherein:

said position and time measuring means constitutes a detection unit;

the rest of said in-vehicle apparatus other than said position and time measuring means constitutes a main unit; and said detection unit is detachably connected to said main unit.

6. An in-vehicle apparatus according to claim 5, wherein said abnormal condition detecting means detects disconnection of communication between said detection unit and said main unit as said abnormal condition.

7. An in-vehicle apparatus according to claim 6, wherein:

said detection unit includes a history data storing means that stores said measurements of said position and time measuring means during said disconnection of said communication between said detection unit and said main unit as history data; and said toll charge control means determines said running state of said vehicle during said disconnection of said communication between said detection unit and said main unit based on said history data stored in said history data storing means once said communication between said detection unit and said main unit is resumed, said toll charge control means forming said toll charging data when said running state of said vehicle during said disconnection of said communication between said detection unit and said main unit satisfies said toll charging condition.

8. An in-vehicle apparatus according to claim 7, wherein said detection unit includes an auxiliary power supply means that continuously supplies power to said detection unit until said measurements of said position and time measuring means are stored in said history data storing means at least once when power supply to said detection unit for operating said detection unit from an external power source is turned off.

9. An in-vehicle apparatus according to claim 1, wherein said communication means is one of the following:

(I) a dedicated short-range communication (DSRC) radio system that communicates with a road side unit located at a running route of said vehicle; and (II) a wireless telephone.

10. An in-vehicle apparatus according to claim 1, further comprising:

a program acquiring means that acquires an application program from said management apparatus through said communication means, said toll charge control means is embodied as a process carried out by a microcomputer, said application program to be acquired by said program acquiring means including a program for embodying at least said toll charge control means; and a reacquisition control means that disables execution of said application program and makes said program acquiring means to reacquire said application program when one of the following occurs:

(I) said abnormal condition is detected by said abnormal condition detecting means; and (II) an instruction to reacquire said application is received from said management apparatus through said communication means.

11. An in-vehicle apparatus comprising:

a first interface means to which measured position and time data is inputted, said measured position and time data indicating a current position of a vehicle and current time;

a communication means that communicates with an external management apparatus to exchange various information through wireless communication;

a toll charge control means that determines a running state of said vehicle based on said measured position and time data inputted through said first interface means and forms toll charging data if said running state of said vehicle satisfies a predetermined toll charging condition, said toll charge control means transmitting said toll charging data to said management apparatus through said communication means, said toll charging data including at least toll information and object identification information, said toll information indicating a toll determined based on said toll charging condition, said object identification information identifying an object to be charged said toll;

an abnormal condition detecting means that detects an abnormal condition in said in-vehicle apparatus; and a monitor control means that forms monitor data when said abnormal condition is detected by said abnormal condition detecting means and transmits said monitor data to said management apparatus through said communication means, said monitor data including at least said measured position and time data inputted through said first interface means.

12. An in-vehicle apparatus comprising:

a position and time measuring means that measures a current position of a vehicle and current time;

a second interface means to which a communication device is connected, said communication device communicating with an external management apparatus to exchange various information through wireless communication;

a toll charge control means that determines a running state of said vehicle based on measurements of said position and time measuring means and forms toll charging data if said running state of said vehicle satisfies a predetermined toll charging condition, said toll charge control means outputting said toll charging data through said second interface means, said toll charging data including at least toll information and object identification information, said toll information indicating a toll determined based on said toll charging condition, said object identification information identifying an object to be charged said toll;

an abnormal condition detecting means that detects an abnormal condition in said in-vehicle apparatus; and a monitor control means that forms monitor data when said abnormal condition is detected by said abnormal condition detecting means and outputs said monitor data through said second interface means, said monitor data including at least said current position of said vehicle and said current time measured by said position and time measuring means when said abnormal condition is detected.

13. An in-vehicle apparatus comprising:

a first interface means to which measured position and time data is inputted, said measured position and time data indicating a current position of a vehicle and current time;

a second interface means to which a communication device is connected, said communication device communicating with an external management apparatus to exchange various information through wireless communication;

toll charge control means that determines a running state of said vehicle based on said measured position and time data inputted through said first interface means and forms toll charging data if said running state of said vehicle satisfies a predetermined toll charging condition, said toll charge control means outputting said toll charging data through said second interface means, said toll charging data including at least toll information and object identification information, said toll information indicating a toll determined based on said toll charging condition, said object identification information identifying an object to be charged said toll;

an abnormal condition detecting means that detects an abnormal condition in said in-vehicle apparatus; and a monitor control means that forms monitor data when said abnormal condition is detected by said abnormal condition detecting means and outputs said monitor data through said second interface means, said monitor data including at least said measured position and time data inputted through said first interface means.

14. A service providing system that makes an in-vehicle apparatus to acquire an application program through wireless communication with an external management apparatus and also makes said in-vehicle apparatus to execute said application program to provide a particular service through said in-vehicle apparatus, said service providing system disabling execution of said application program by said in-vehicle apparatus when an abnormal condition of said in-vehicle apparatus is detected, said service providing system then making said in-vehicle apparatus to reacquire said application program.

15. A service providing system according to claim 14, said service providing system making said in-vehicle apparatus to store a setup log of said application program in said in-vehicle apparatus, said service providing system making said in-vehicle apparatus to transmit said setup log to said management apparatus through said wireless communication and then making said management apparatus to store said setup log of said application program, said service providing system comparing said setup log stored in said in-vehicle apparatus and said setup log stored in said management apparatus through said wireless communication from time to time, said service providing system regarding presence of a difference between said setup log stored in said in-vehicle apparatus and said setup log stored in said management apparatus as said abnormal condition.

* * * * *